US005083392A

United States Patent [19]

Bookstaber

[11] Patent Number: 5,083,392

[45] Date of Patent: Jan. 28, 1992

[54] FIREARM WITH PIEZO-ELECTRIC TRIGGERING AND FIRING MECHANISM

[76] Inventor: Richard M. Bookstaber, 56 Byron Rd., Short Hills, N.J. 07078

[21] Appl. No.: 552,829

[22] Filed: Jul. 16, 1990

[51] Int. Cl.[5] ..... F41A 19/62

[52] U.S. Cl. ..... 42/84

[58] Field of Search ..... 42/84, 70.11; 89/28.05, 89/28.1, 135

[56] References Cited

U.S. PATENT DOCUMENTS

| | | | |
|---|---|---|---|
| 3,859,746 | 1/1975 | Pecksen | 42/84 |
| 3,982,347 | 9/1976 | Brandl et al. | 42/84 |
| 4,275,521 | 6/1981 | Gerstenberger et al. | 42/84 |
| 4,329,803 | 5/1982 | Johnson et al. | 42/84 |
| 4,347,679 | 9/1982 | Grunig et al. | 42/84 |
| 4,757,629 | 7/1988 | Austin | 42/84 |

*Primary Examiner*—Charles T. Jordan

*Attorney, Agent, or Firm*—Brumbaugh, Graves, Donohue & Raymond

[57] ABSTRACT

A piezo-electric trigger lever transmits a signal to a piezo-electric mechanism which releases the firing pin of a firearm. The signal from the trigger lever is passed through an electronic circuit or microprocessor which can process the signal before it is passed on to fire the firearm. The processing may include regulating the firing as a function of the pressure applied to the trigger; preventing operation unless the operator enters a predetermined code into the electronic logic circuit; and, in the case of an automatic firearm, regulate the number of shots fired per trigger pull. The operator may make in-the-field adjustments in these controls. The signal is transmitted from the logic circuit to a second piezo-electric device. This second device deflects to allow the release of the firing pin. Other pressure sensitive piezo-electric devices can be employed to act as safety mechanisms.

9 Claims, 6 Drawing Sheets

FIREARM WITH PIEZO-ELECTRIC TRIGGERING AND FIRING MECHANISM

BACKGROUND OF THE INVENTION

The present invention relates to the triggering and firing mechanism of a firearm. Conventional firearm mechanisms are totally mechanical, relying on a set of levers, springs, and sears to transform the pull of the trigger lever to a release of the firing pin. Despite their development over a period of literally hundreds of years, these mechanisms continue to have limitations. The sensitivity of the mechanism cannot be increased beyond a point without increasing limitations on reliability and without increasing cost. Furthermore, the mechanism cannot be readily adjusted by the operator to account for different preferences in areas such as trigger pull or the number of shots fired per trigger pull (in the case of an automatic firearm). The mechanical structure also places certain limitations on the nature of the safety and locking mechanism.

A number of triggering mechanisms have been proposed that use electro-mechanical devices to release the firing mechanism of a firearm (e.g. U.S. Pat. No. 4,757,629; U.S. Pat. No. 4,347,679; U.S. Pat. No. 4,329,803; U.S. Pat. No. 4,275,521). The mechanical release of the firing pin is replaced with a release mechanism that is electrically induced. These devices focus primarily on target shooting, where they seek advantages of cost-effectiveness and a simpler releasing mechanism than more expensive mechanical target firearm triggers.

The prior work on electro-mechanical triggering devices centers primarily on the release mechanism for the firing pin. In all cases, the trigger lever operated by the shooter is a mechanical switch similar in nature to conventional fully mechanical triggers or, in some cases, similar in function to a mechanical electric switch.

With the exception of the firearm proposed in U.S. Pat. No. 4,275,521, these electrical mechanisms employ an electromagnet with a moveable armature. These devices by nature involve a comparatively long release time because it takes time for the magnetic field to build up once the electric circuit is turned on. Also, the use of electromagnetic force requires an ample battery storage, which is difficult to provide in the limited space of a firearm. While such a battery may be practical in target shooting, it would be cumbersome and unreliable for many other firearm applications. Furthermore, the array of electrical components, typically including magnets, capacitors, and solenoid coils, tends to be heavy, bulky, and of questionable reliability for some firearm applications.

U.S. Pat. No. 4,275,521 proposes a firearm in which an electromagnet for releasing the firing pin is replaced by a piezo-electric element. This requires less electric current than the aforementioned magnetic devices, and also has a shorter release time. The present invention improves on this application is several ways. First, it contemplates the use of recent piezo-electric products, such as polyvinylidene fluoride (PVDF), which are not mentioned as possible piezo-electric agents in the above patent. Second, it extends the use of the piezo-electric technology beyond the firing mechanism to the trigger lever operated by the shooter, and to the safety mechanism for the firearm. Third, it seeks to exploit the flexibility and control inherent in electronic devices to allow the operator to control the specifics of the firing mechanism in the field.

SUMMARY OF THE INVENTION

One objective of this invention is to employ a trigger where the signal input from the operator, the firing pin release, and the firing safety mechanism are electronically driven. The present invention replaces the mechanical triggering and firing mechanism with an electronic one. The mechanism employs piezo-electric materials which allow the firing train, from the operator's application of pressure on the trigger lever to the release of the firing pin, to be dictated by electronic impulses rather than the transfer of mechanical forces. The piezo-electric trigger converts the pressure of the operator's finger on the trigger lever into an electric potential. This potential is then transferred to a second piezo-electric device which is employed in restraining the firing pin. When the electric potential is passed to this second device, it causes it to deflect or deform sufficiently to release the firing pin, thereby firing the firearm.

The path from the first piezo-electric device to the second device can include a set of electronic controls. For example, one possible control, a comparator, compares the potential received from the first piezo-electric device to a preset level, and transmits an electric potential to the second piezo-electric device only if the potential received exceeds that of the preset level. This assures a minimum trigger pressure will be required to discharge the firearm.

An innovative feature of these controls is the ability of the operator to adjust them readily in the field. The adjustments can be made by manipulating controls mounted on the firearm as readily as volume adjustments can be made with electronic sound equipment. The electronic nature of the device will afford economies and efficiencies similar to those that are manifest in many fields where electronic devices have been invented to replace mechanical devices. The electronic nature of the device permits a level of control by the operator that is not possible with mechanical triggers. It also allows economies of production. Furthermore, the reduction in moving parts provides the potential for greater reliability and less wear and tear during use. The nature of the piezo-electric substances is inherent in their molecular structure; they therefore may be less subject to the failures that can occur with mechanical triggers, where a precise maintenance of the physical alignment of the component parts is required for successful action.

Trigger Lever

In the present invention, we define the trigger lever as the means by which the operator inputs the signal to fire the firearm. In a conventional firearm, the trigger lever is the part of the firearm which the operator pulls to activate its firing; in the present invention, the actor in the trigger lever is a pressure-sensitive piezo-electric device rather than the mechanical pull of the lever itself. One embodiment of such a pressure-sensitive piezo-electric device is a piezo-electric film, polyvinylidene fluoride (PVDF), which exhibits the highest piezo-electric activity of any currently known plastic. When this film experiences tensile or compressive stress, it develops a distributed electric charge across its surface. If leads are attached to a metallized surface on the film, the charge differential will result in an electric voltage across the leads. The signature of this voltage—its amplitude and time-response characteristics—varies with the dynamic stress placed on it. Unlike a mechanical switch, which provides a flow path for the electric current, the piezo-electric switch sends its signal as a voltage waveform.

There are a number of attractive features for using such a triggering mechanism in a firearm. First, since it is not a "hard contact" switch, it is comparatively unaffected by dirt, moisture, and other contaminants that may foul mechanical triggers or even mechanically driven electrical switches. Second, the waveform is generated directly by the stress itself. No external source of electrical power is necessary. Third, the waveform is determined not only by the application of stress, but by the changes in stress as a function of time. Thus, for example, a small but continual pressure on the trigger will not generate the same waveform as a quick, sudden application of pressure. The fact that different trigger "pulls" will lead to different waveforms means that a microprocessor or other electronic circuitry can be used to filter out extraneous or unintentional forces on the trigger. This can provide a safety mechanism that is not possible with other designs. Fourth, the piezo switch can be set to a very low pressure sensitivity, allowing a "hair-trigger" action that is difficult to achieve inexpensively and reliably with a mechanical trigger.

The trigger lever in the present invention need not in fact be a lever at all, since it is the pressure applied to the piezo-electric device, and not the movement of the trigger lever, that is the input signal for firing the firearm. However, the piezo-electric device may be mounted like a conventional mechanical trigger lever in order to conform with the "look and feel" of a conventional mechanical trigger. In operating a firearm, many shooters are accustomed to the feedback of both trigger pressure and trigger carry—the distance the trigger moves before the firing pin is disengaged. The electronic trigger may be mounted to have carry before there is sufficient mechanical resistance to allow the requisite stress on the piezo-electric device. This may be done with a conventional mechanical mount, or a flexure or snap-action switch can be used to have trigger carry precede the activation of the electrical signal. A snap action switch stores a mounting force until it suddenly breaks over, or "clicks." This sudden movement stresses the film, and provides a dynamic voltage. The snap action provides carry, ending with a signal at the time of the snap.

Control Circuitry

The waveform generated from the operator's input to the trigger lever may be passed through a set of circuits before activating the firing mechanism. These circuits are intended to fulfill a number of control functions. They can filter the waveform on the basis of amplitude or other waveform characteristics, thereby restricting discharge to a range of trigger pressures and trigger pull speeds. They can also act as a safety lock by passing the signal to activate the firing mechanism only if a predetermined operating code is entered into the circuitry. In an automatic firearm, they can send a predetermined set of timed impulses to the firing mechanism in response to each trigger pull. This will add a dimension of control to automatic firearms, since the operator can specify the burst rate and the burst size—the number of rounds fired per trigger pull. The parameters of these functions can be readily set and altered by the operator through controls mounted on the firearm.

These functions may all be programmed into and controlled by a microprocessor. Or, the circuitry may be fashioned with conventional electronic components. For example, the circuitry may include a set of comparators. The comparator takes the incoming signal from the trigger, and sends a signal out to the firing mechanism only if the incoming signal is in a specified amplitude range. The specified range can be easily set by a switch to be in the extremely light, "hair-trigger" range where an ounce or less of force is sufficient to send a signal, to a range of a number of pounds, as is conventional for most firearms.

The circuitry may include an EEPROM or other memory storage device to maintain a code number in memory, and only fire if the operator has entered the same code into the circuitry before activating the firearm. This provides an internal trigger lock, creating a firearm with some proprietary features.

In the case of an automatic firearm, the circuitry may also include a counter which sends out a specified number of timed signals upon the receipt of a signal from the trigger lever. The specification of the number of times the firearm fires per trigger pull can be set by the operator and stored in an EEPROM or other memory storage device. The number of the signals that are sent to the firing mechanism will dictate the number of times the firing pin will be released, and the timing of the signals will dictate the speed of firing. Since the recovery time of an automatic weapon varies according to the sliding mechanism which discharges the spent round and loads the next round into the firing chamber, the minimum interval that is allowed must be set to be greater than the recovery time if each displacement of the firing mechanism is to lead to an additional shot being fired.

The circuitry requires a battery power source to serve its function.

Firing Mechanism

We exploit the dual capacity of a piezo device both to translate stress or displacement into an electrical impulse, and to translate an electrical potential into a physical displacement or deformation. The signal output from the trigger lever and the filtering circuitry is sent to a piezo-electric device which converts the electrical potential into a displacement sufficient to bend the piezo device out of the way of the sear, thereby disengaging the firing pin from its cocked position.

In its more sensitive settings, the piezo device in the trigger will not generate sufficient voltage to displace the piezo device that is retaining the sear. The circuitry therefore requires a power source to provide an adequate voltage signal to the piezo-electric device that releases the firing pin.

Routine maintenance of the firearm will include periodic replacement of the power sources for the circuitry and for the activation of the piezo-electric devices. Since reliability is paramount for many firearm applications, the present invention contemplates the use of diagnostic or warning devices to indicate the battery has sufficient power to maintain the operation of the firearm.

Safety Mechanisms

The electronic nature of the firearm trigger allows the introduction of innovative safety mechanisms. In a conventional firearm, the safety mechanism is a mechanical lever or latch that restrains the action of the firing train, or that blocks the path of the firing pin. The present invention also allows for electronic intervention. Such intervention may take the form of a lever or latch which blocks the signal path. It may also include the use of additional piezo-electric devices which add input to the signal of the trigger lever.

The safety mechanisms may be placed in positions that are common for conventional firearm safety mechanisms. A piezo device may be placed in the butt of the grip, where pressure from the hand holding the firearm will deliver a signal to the electronic circuit. It may also be placed on either side of the firearm, where pressure from the thumb or another finger provides a signal to the electronic circuit. The signal deflects a piezo-electric device that otherwise restrains the firing mechanism from releasing even if the primary piezo-electric device or the sear fails. The circuit can be constructed to require these signals to be present in addition to the pressure from the trigger lever in order for the output signal to be transmitted from the circuit to allow the firearm to fire.

In a preferred embodiment of the invention piezo-electric transducers are used in the firing release (release of the sear) and the safety latch. In each case a voltage applied to the transducer causes a deformation of the transducer which produces a force that disengages an element driven by the transducer from a component of the firing mechanism. The degree of deformation and the magnitude of the force output of these transducers, which are of the bimorph or bender type, are functions of the materials used, the dimensions and geometry of the bimorphs and the voltages applied to them. Polyvinylidene fluoride bimorphs provide relatively large displacements—displacements of 5 to 10 mm are attainable—but produce only relatively small forces. Other common piezo materials, such as piezo-electric ceramics, produce greater forces, but lesser deflections. With proper mounting and the use of a mechanical extension of the device, deflections of 5 mm or more are attainable.

DESCRIPTION OF THE ILLUSTRATED EMBODIMENTS

Figure 1:
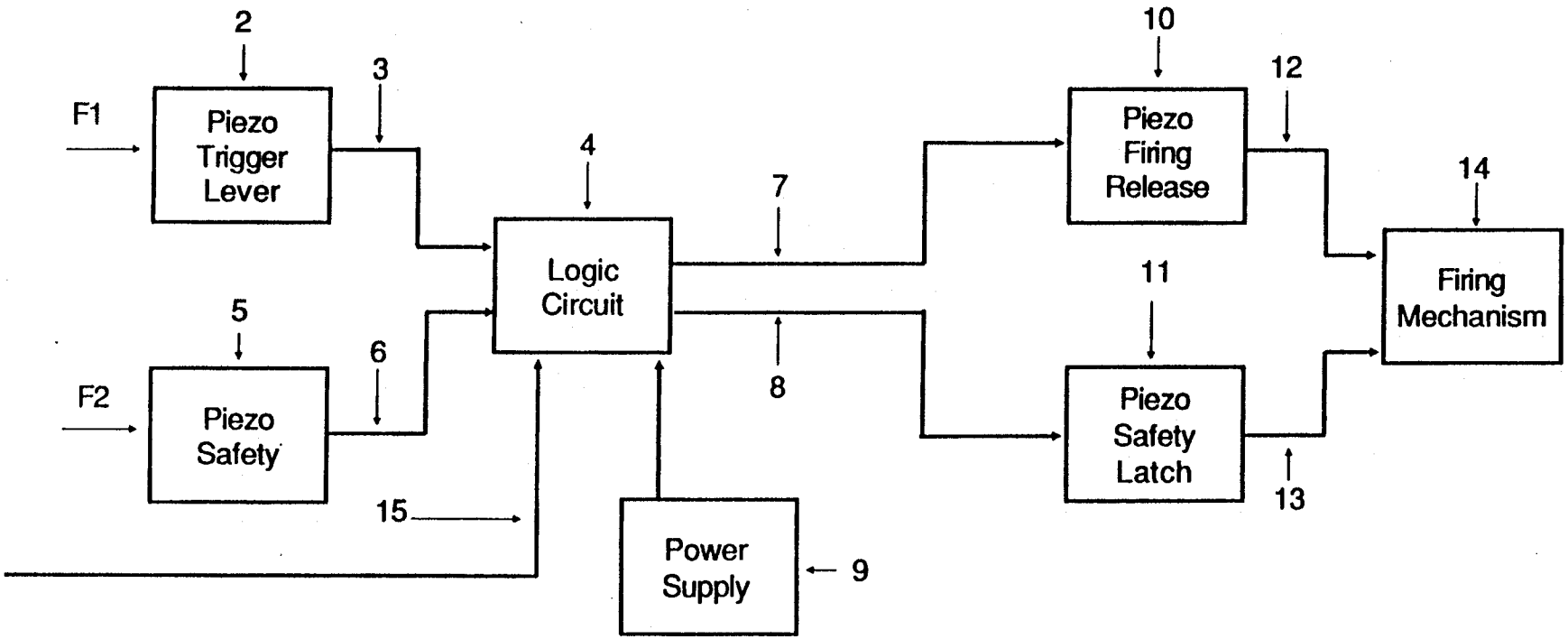
FIG. 1 is a block diagram of an embodiment of the invention.

Referring to FIG. 1, a piezo-electric device located at the trigger lever 2 receives a pressure input F1 from the operator of the firearm. The pressure on the piezo-electric device 2 produces a voltage waveform on lead 3 which enters into the logic circuit 4. A hand pressure input F2 from the operator also activates a piezo safety 5 which sends a second signal over a lead 6 to the logic circuit 4.

The logic circuit processes these inputs in a number of ways according to the specifications of the operator. The operator provides parameter specifications as inputs which are stored in the logic circuit. These specifications can be made far in advance of firing. Based on the characteristics of the input signals supplied over leads 3 and 6 and the parameter specifications, the logic circuit makes a decision to send output signals over leads 7 and 8 to a piezo firing release device 10 and a piezo safety latch 11. The safety latch is disengaged by the signal generated through the safety 5. This disengagement occurs as the input voltage from the safety 5 signals an output voltage from the logic circuit. With the safety latch disengaged, firing will occur when the trigger lever device is actuated. The deflection 13 in the safety latch and deflection 12 in the firing release will actuate the firing mechanism 14. The output voltage and the logic circuit are powered by a power supply 9, which typically would be a battery contained within the firearm.

Figure 2:
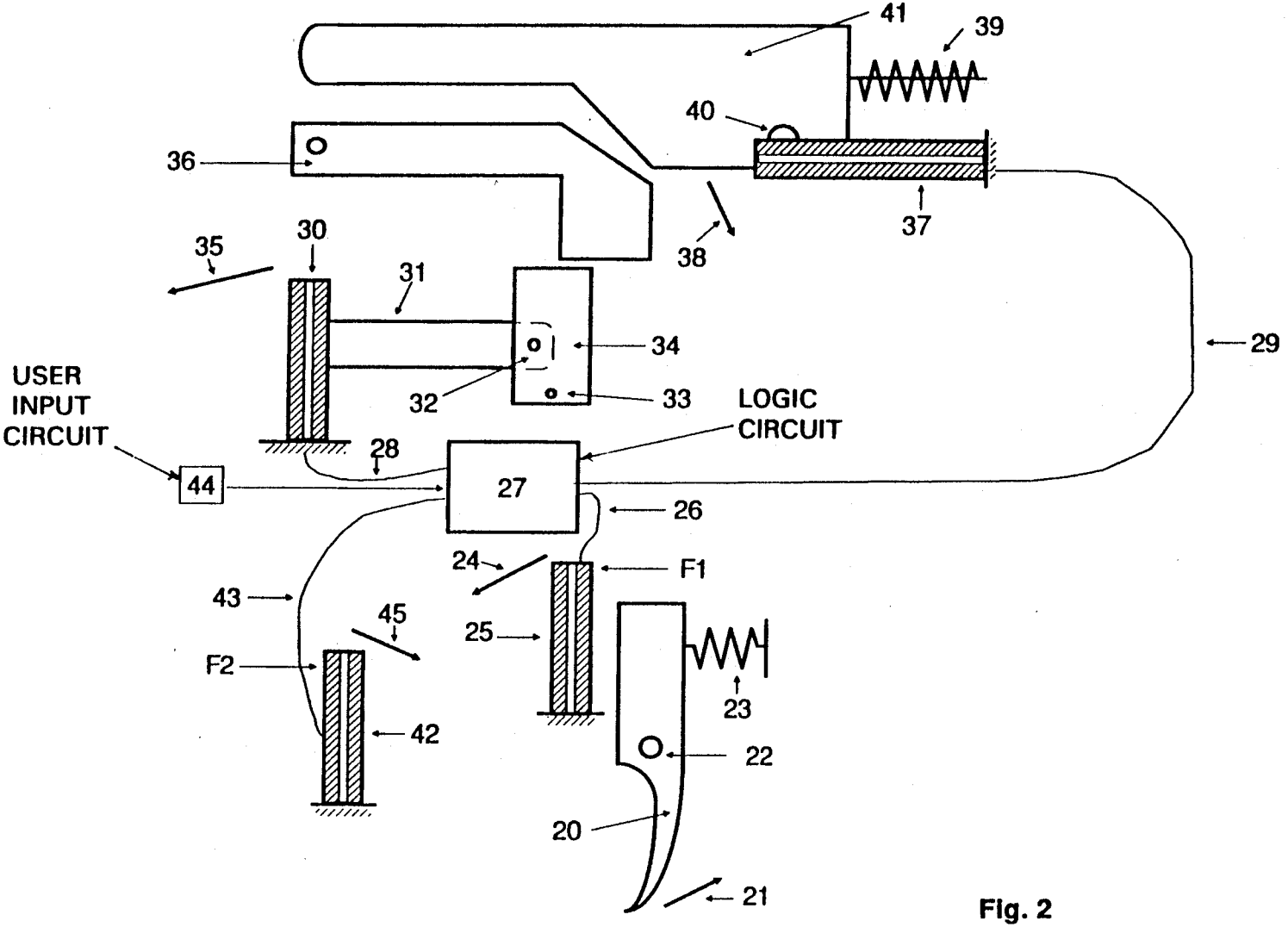
FIG. 2 is a schematic drawing of the embodiment.

FIG. 2 shows schematically the components of an embodiment of the invention. To fire the firearm, the operator applies pressure to the trigger lever 20 in the direction of the arrow 21. The trigger lever, which is otherwise restrained from motion in this direction by the spring 23, then rotates on the pin 22, applying pressure on the trigger lever piezo-electric device 25.

The trigger lever is designed in the present embodiment to allow carry in the trigger pull. An alternative embodiment is to have the trigger lever in direct contact with the piezo device 25 and have the pressure exerted directly without any trigger carry. In the present embodiment the retaining spring 23 exerts a force that must be overcome in order to fire the firearm. Thus a minimum level of pressure is necessary no matter what pressure sensitivity is selected for a signal from the piezo device 25. The alternative embodiment would allow the firearm to be fired with pressure from the operator even lower than that necessary to overcome the force of the spring.

The pressure F1 on the piezo-electric device 25 displaces it in the direction of the arrow 24, and results in a signal voltage being sent through the input lead 26 to the logic circuit 27. The logic circuit and the input of the operator-specified parameters for the circuit 44 are drawn as a block in FIG. 2. More detailed schematics of the logic circuit, operator-specified adjustments in the parameters of the circuit's operation, and the power source required for the circuit's operation and for sending the voltage outputs, are presented in other figures and described below, Pressure F2 by the operator is also exerted on an input piezo-electric safety device 42 deflecting it in the direction of the arrow 45, which then sends a second input signal over a lead 43 to the logic circuit 27. This safety device may be placed in the butt of the firearm grip, where hand pressure from gripping the firearm will activate it, or in a position of a conventional side safety latch, where thumb pressure will activate it.

The input voltage signal on lead 43 is processed by the logic circuit, leading to an output voltage on lead 29 sufficient to deflect the piezo-electric firing safety mechanism 37 which is restraining the firing pin assembly 41. This restraint is accomplished by a retaining pin 40 in the firing pin assembly which fits through a pin retaining hole in the piezo device. (The retaining hole is not shown in the figure). The retaining pin 40 is recessed in the firing pin assembly so that it does not interfere with the forward movement of the assembly at the time of firing. The deflection of the firing safety mechanism is in the direction of the arrow 38. The displacement must be at least as great as the length of the retaining pin 40 at the point that the retaining pin is inserted into the piezo device 37. This suggests the placement of the pin near the point of maximum deflection.

When signals conducted through leads 26 and 43 activate an output voltage through the output lead 28, the output voltage deflects the firing release piezo device 30 in the direction of arrow 35. This deflection initiates process of firearm firing which then follows a firing train similar to that of conventional, fully mechanical firearms. The deflection of the piezo device 30 acts through a link 31 to pivot the sear support 34 about its pivot pin 33. The pivot frees the sear 36, which then permits the mainspring 39 to force the firing assembly 41 forward, firing the firearm.

Figure 3:
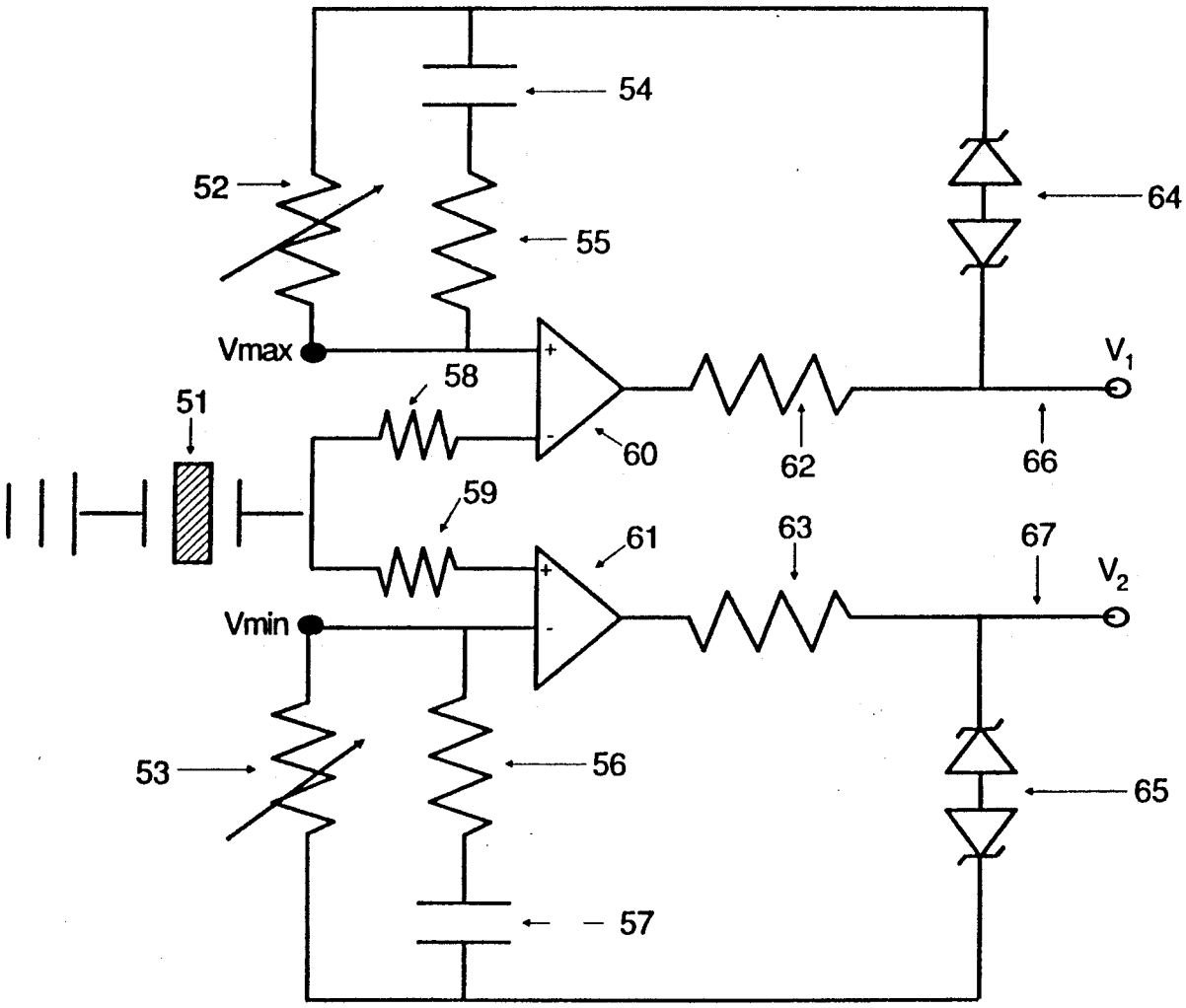
FIG. 3 is a schematic diagram of the electronic circuitry to regulate the output signal as a function of the amplitude of the input signal.

FIG. 3 shows the circuitry of two comparators that compare the voltage generated by the pressure on the piezo trigger device to preset values, Vmin and Vmax. Vmin and Vmax define the maximum and minimum voltages, and hence pressure, that the piezo trigger device must generate to activate the firearm. They are a fraction of the voltage supply 54 and 57 adjusted by variable resistors 53 and 52. Op amps 60 and 61 perform the comparisons of the voltage generated by the trigger device and raise the output to +supply or −supply. The voltage put out by the op amps will be clamped by the zener diodes 64 and 65. Other resistors are employed in the circuit as noted by 55, 56, 58, 59, 62 and 63.

This circuit essentially defines a TTL output comparator, which can be installed as a single component.

Figure 4:
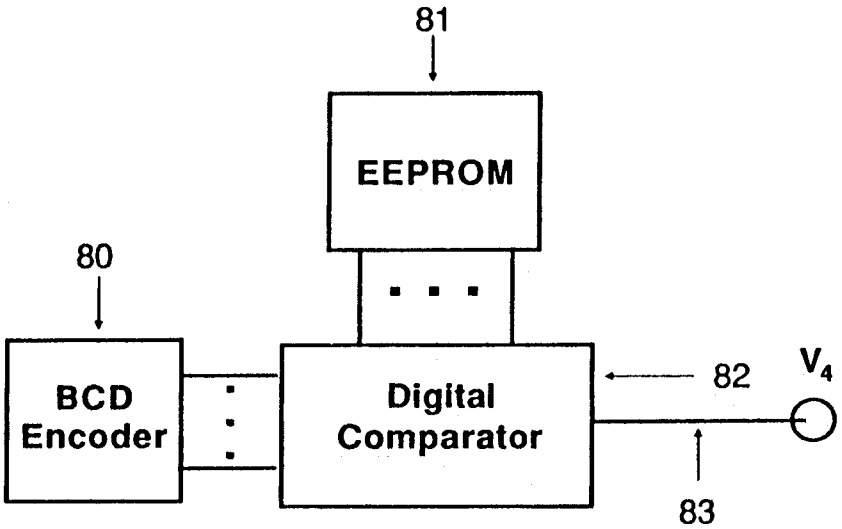
FIG. 4 is a schematic diagram of the electronic circuitry to regulate the output signal as a function of the input of a security code.

FIG. 4 illustrates schematically a circuit for storage and use of a security code to activate the firearm. A security code of a predetermined number of digits is stored in the EEPROM 81. This code is compared by a digital comparator 82 with a code input by the operator via a BCD encoder 80. The comparator puts out a voltage on lead 83 if the two codes match.

Other memory storage media are possible for storing the input code. Indeed, the EEPROM is a relatively expensive storage device. However, it has the advantage of storing the input values without the need for continual power input. Thus if the batteries should fail, or should the batteries be taken out of the firearm temporarily, the EEPROM will continue to hold the values in memory.

Figure 5:
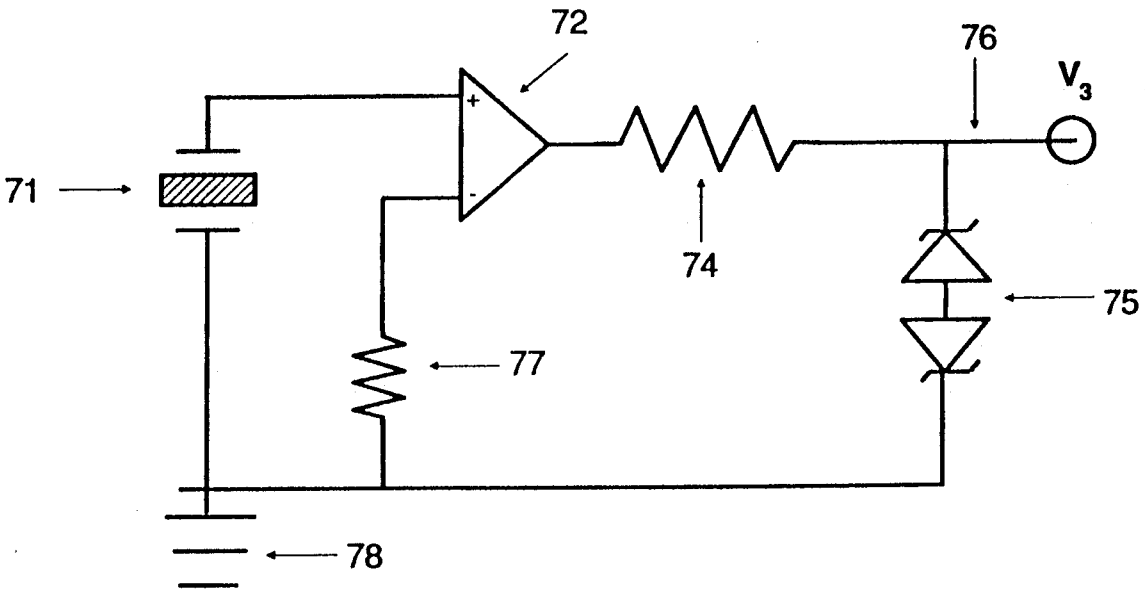
FIG. 5 is a schematic diagram of the electronic circuitry to regulate the output signal as a function of the receipt of an input signal from both the safety and trigger lever devices.

FIG. 5 illustrates a circuit for the piezo safety device. Pressure on the piezo device 71 passes an input voltage to the op amp 72. If the signal is of sufficient voltage to indicate a disarming of the safety, a signal is output on lead 76. The signal may be conducted directly to the safety release mechanism 37 or it may be conducted to the logic circuit 27 and processed for delivery over lead 29 to the safety release mechanism 37 (see FIG. 2). The circuit also indicates a zener diode 75, resistors 74 and 77, and the conventional ground 78.

Figure 6:
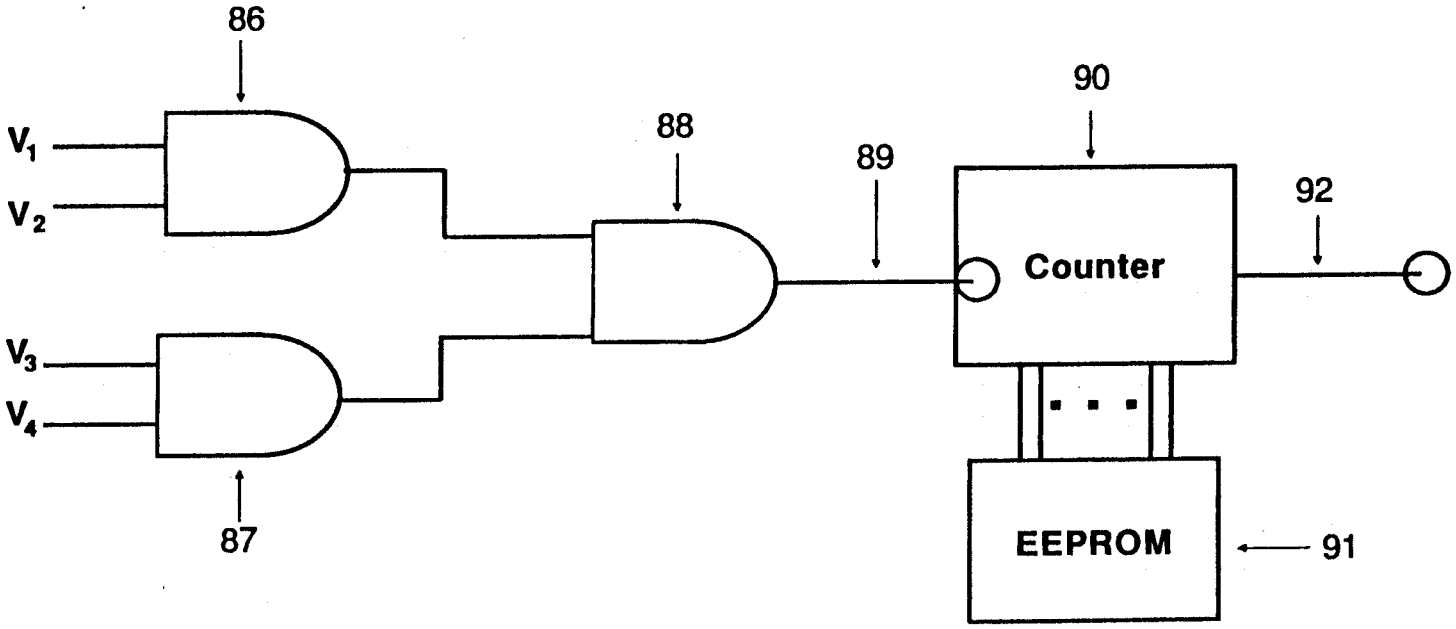
FIG. 6 is a schematic diagram of the electronic circuitry to regulate the number of output signals sent to the firing mechanism of an automatic firearm for each input signal received.

FIG. 6 shows a counter for automatic firearms, and also includes the combining of the input signals from the various trigger and safety devices into an AND gate, preparatory to the signal being sent on to the firing mechanism to fire the firearm.

The signals which provide verification that the trigger signal is above a minimum threshold, signal on lead 66 in FIG. 3; that the trigger signal is below a maximum threshold, signal on lead 67 in FIG. 3; that the appropriate code has been entered into the security lock, signal on lead 83 in FIG. 4; and that the safety has been disengaged, signal on lead 76 in FIG. 5; all enter into a counter 90, through a set of AND gates 86, 87, and 88. The signal reaches the counter and enables it on lead 89 only if all four input signals are on. An EEPROM 91 stores the number of signals to be sent on to the firing mechanism. Upon receipt of the signals, the counter sends the appropriate number of output voltage signals to the firing release piezo device, thereby firing the firearm.

Rather than the counter sending a set of individual pulses to the firing mechanism, the circuit could replace the counter with a timer which keeps the signal on, maintaining the piezo safety and piezo firing device in an unlatched position for a specified amount of time. By correlating the timing that the devices remain open with the timing for each firing of the automatic firearm, the same effect of controlling the number of shots per trigger pull could be attained. A timer would have an advantage for very rapidly cycling firearms, since the practical operation of the counter is limited by the recycling speed of the piezo-electric devices at the firing mechanism and the firing safety.

The embodiment of the circuitry shown in FIGS. 3, 4, 5, and 6 illustrates the construction of the appropriate circuits to fulfill the functions of the present invention. The present invention contemplates replacing the set of components described here with a microprocessor that can readily perform the same electronic and logical functions. Such microprocessors are inexpensive in large-scale production and have low power consumption. For firearm applications, they have the additional properties of being small, light, and reliable.

I claim:

1. A firearm comprising a trigger member adapted to be displayed by a user, piezo-electric transducer means deformable by the trigger member upon displacement thereof for producing an electrical signal indicative of the pressure on the trigger member producing such displacement, firing means for firing the firearm in response to the electrical signal produced by the transducer means, processor means coupled to the transducer means and the firing means for receiving the electrical signal, comparing it to at least one signal indicative of at least one predetermined desired characteristic of the displacement of the trigger and producing an output signal to the firing means only when the displacement of the trigger by the user conforms to said characteristic.

2. A firearm according to claim 1 and further comprising input means operable by the user and coupled to the processor means for supplying to the processor means signals indicative of a security code and wherein the processor is adapted to be encoded with the security code and includes means for comparing the signal from the input means with the encoded security code and supplying an output signal to the firing means only when the security code input by the user matches the encoded security code.

3. A firearm according to claim 1 wherein the firing means includes means for automatically discharging the firearm repeatedly and further comprising processor means coupled to the transducer means and the firing means for receiving the electrical signal and for processing it into a predetermined number of output signals or time of signal to the firing means so as to discharge the firearm a predetermined number of times in response to a single displacement of the trigger.

4. A firearm according to claim 3 and further comprising means operable by the user for producing and supplying to the processor means signals indicative of a desired number of discharges of the firearm and wherein the processor means includes means for storing said signals and generating in response to them an equal number of output signals or time of signal duration to the firing means.

5. A firearm according to claim 1 wherein the firing means includes a firing pin, a sear pivotally mounted for movement between a first position in which it blocks movement of the firing pin in a direction to discharge the firearm and a second position in which it permits movement of the firing pin to discharge the firearm, and a piezo-electric transducer engageable with the sear in the absence of an electrical signal supplied to it to retain the sear in its first position and movable out of engagement with the sear in response to an electrical signal generated in response to displacement of the trigger member by said piezoelectric transducer means to enable movement of the sear to its second position.

6. A firearm according to claim 1 wherein the firing means includes a firing pin and further comprising safety means associated with the firing means for preventing the firearm from being discharged in response to displacement of the trigger member and including a safety piezo-electric transducer engageable with the firing pin in the absence of an electrical signal supplied to it to prevent movement of the firing pin in a direction to discharge the firearm and movable out of engagement with the firing pin to enable it to move in a direction to discharge the firearm in response to an electrical signal supplied to it and means operable by the user for generating an electrical signal and supplying it to the safety piezo-electric transducer.

7. A firearm according to claim 6 wherein said means operable by the user includes a piezo-electric transducer.

8. A firearm according to claim 1 wherein the firing means includes a firing pin and further comprising safety means associated with the firing means for preventing the firearm from being discharged in response to displacement of the trigger member and including a safety piezo-electric transducer engageable with the firing pin in the absence of an electrical signal supplied to it to prevent movement of the firing pin in a direction to discharge the firearm and movable out of engagement with the firing pin to enable it to move in a direction to discharge the firearm in response to an electrical signal supplied to it and means operable by the user for generating a safety release signal to indicate a desired to release the safety means and supplying it to the processor means, and wherein the processor means includes means for generating an output to the firing means only in response to simultaneous reception of a safety release signal and a signal from the piezo-electric transducer means.

9. A firearm according to claim 8 wherein said means operable by the user includes a piezo-electric transducer.

* * * * *